US009961447B2

(12) United States Patent
Windischberger et al.

(10) Patent No.: US 9,961,447 B2
(45) Date of Patent: May 1, 2018

(54) MICRO SPEAKER

(75) Inventors: Susanne Windischberger, Vienna (AT); Maria Papakyriacou, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 518 days.

(21) Appl. No.: 13/380,428

(22) PCT Filed: Jun. 23, 2010

(86) PCT No.: PCT/IB2010/052846

§ 371 (c)(1),
(2), (4) Date: Dec. 22, 2011

(87) PCT Pub. No.: WO2010/150203

PCT Pub. Date: Dec. 29, 2010

(65) Prior Publication Data

US 2012/0093353 A1 Apr. 19, 2012

(30) Foreign Application Priority Data

Jun. 26, 2009 (EP) ..... 09163935

(51) Int. Cl.
*H04R 25/00* (2006.01)
*H04R 7/10* (2006.01)
(Continued)

(52) U.S. Cl.
CPC ..... *H04R 7/10* (2013.01); *H04R 1/22* (2013.01); *H04R 31/003* (2013.01); *H04R 7/22* (2013.01); *H04R 9/06* (2013.01); *H04R 2307/029* (2013.01); *H04R 2499/11* (2013.01); *Y10T 29/49005* (2015.01)

(58) Field of Classification Search
CPC ... H04R 2307/029; H04R 31/003; H04R 7/02
USPC ..... 381/398, 396, 403, 405, 423, 426, 381/430–433, 386, 400, 401, 190; 181/167, 166, 168, 169, 171–173; 455/90.3
See application file for complete search history.

(56) References Cited

U.S. PATENT DOCUMENTS 6,654,476 B1 * 11/2003 Guenther ..... 381/407
7,529,520 B2 * 5/2009 Edgren ..... 455/90.3
(Continued)

FOREIGN PATENT DOCUMENTS

EP 1079662 A2 2/2001
EP 1175126 A1 1/2002
(Continued)

OTHER PUBLICATIONS

International Search Report and Written Opinion for International Patent Application PCT/IB/2010/052846 (dated Nov. 26, 2010).

*Primary Examiner* — Davetta W Goins
*Assistant Examiner* — Phylesha Dabney
(74) *Attorney, Agent, or Firm* — Steven McMahon Zeller; Dykema Gossett PLLC

(57) ABSTRACT

A speaker comprises a permanent magnet (2) and a coil (8) positioned around the permanent magnet (2) and attached to a membrane (10), wherein the membrane comprises an elastomer of thickness less than 0.3 mm and with a Young's modulus below 100 MPa.

16 Claims, 1 Drawing Sheet

Figure 1:
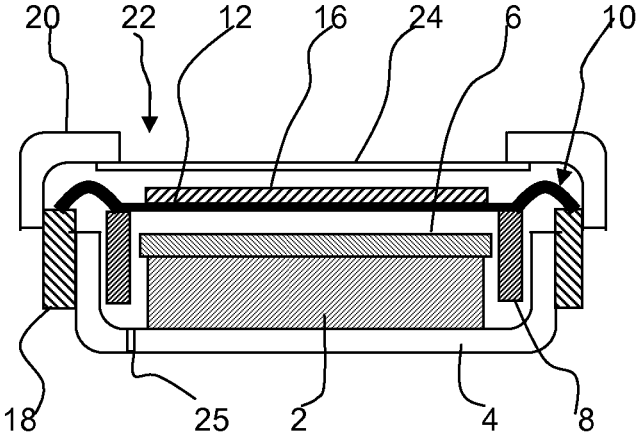

(51) Int. Cl.

| | |
|---|---|
| ***H04R 1/22*** | (2006.01) |
| ***H04R 31/00*** | (2006.01) |
| *H04R 7/22* | (2006.01) |
| *H04R 9/06* | (2006.01) |

(56) References Cited

U.S. PATENT DOCUMENTS

| | | | | |
|---|---|---|---|---|
| 7,644,801 | B2 * | 1/2010 | Klein et al. | 181/157 |
| 8,687,838 | B2 * | 4/2014 | Mitsui et al. | 381/401 |
| 2001/0050194 | A1 * | 12/2001 | Ishihara et al. | 181/167 |
| 2002/0153194 | A1 * | 10/2002 | Pocock et al. | 181/167 |
| 2004/0057596 | A1 * | 3/2004 | Green et al. | 381/423 |
| 2008/0053745 | A1 * | 3/2008 | Tada et al. | 181/165 |
| 2009/0028376 | A1 * | 1/2009 | Saito et al. | 381/423 |
| 2009/0122379 | A1 * | 5/2009 | Kagawa et al. | 359/221.2 |
| 2010/0092011 | A1 * | 4/2010 | Windischberger et al. | 381/190 |

FOREIGN PATENT DOCUMENTS

| | | | |
|---|---|---|---|
| GB | 2087688 | A | 5/1982 |
| WO | 01/13677 | A1 | 2/2001 |
| WO | 2006/095280 | A1 | 9/2006 |
| WO | 2007/000678 | A2 | 1/2007 |

* cited by examiner

MICRO SPEAKER

CROSS REFERENCE TO RELATED APPLICATIONS

This application is a National Phase of PCT International Application No. PCT/IB2010/052846, filed Jun. 23, 2010, which claims priority under 35 U.S.C. § 119 to European Patent Application No. 09163935.1 filed Jun. 26, 2009, the entire disclosures of which are herein expressly incorporated by reference.

This invention relates to a micro speakers, for example for use in reproducing sound in microelectronic equipment such as mobile phones, cellular phones, camcorders, PDAs, digital cameras, notebook computers, LCD TVs, DVDs and the like.

Micro speakers are used when space is at a premium. In such applications, it is desired that the speaker should be as compact as possible and the back volume (which forms part of the mounting structure of the speaker) should be as small as possible. However, it is also desired that the speaker should be able to output in the broadest range of frequencies possible. These are conflicting requirements.

The speaker comprises a membrane attached to a voice coil, which is positioned within a magnetic field defined by a permanent magnet and yoke arrangement. The performance of the speaker is dependent on the resonant frequency. Above the resonant frequency, the output response is relatively flat, Therefore a low resonant frequency give rise to a wideband performance. The resonant frequency is a function of the stiffness and the mass of the moving parts. The stiffness of the moving parts is dependent on two factors: the stiffness of the membrane and the stiffness of the back volume.

The membrane in conventional micro speakers comprises a thermoplastic foil formed by deep drawing or stamping. The foil has Young's modulus typically in the range of 1-2 GPa. This results in a relatively high resonant frequency, typically at least 750 Hz.

According to the invention, there is provided a speaker comprising a permanent magnet and a coil positioned around the permanent magnet and attached to a membrane, wherein the membrane comprises an elastomer of thickness less than 0.3 mm and with a Young's modulus below 100 MPa.

The invention is based on the recognition that the compliance (which is the inverse of stiffness, which in turn is meanly defined by the Young's modulus) of the membrane should be as high as possible. This means the resonant frequency is dominated by the effect of the back volume. The high compliance of the membrane is preferably at least a factor of 10 higher than the compliance of the back volume for this purpose. The back volume can then be selected to be as small as possible whilst maintaining the resonant frequency below a desired threshold, and thereby maintain wide-band performance.

A small back volume implies a small compliance of the back volume, so that the reduction of back volume can only be carried out to a limit for given optical performance. With the high compliance of the membrane in accordance with the invention, the back volume can be reduced to a minimum.

The elastomer can comprise silicone. The membrane is preferably injection moulded, and silicones are available with the desired low Young's modulus and which can be injection moulded. The membrane preferably comprises a single layer monolithic structure.

To keep the speaker profile as low as possible, the membrane can comprise a flat central region and a torus, and the speaker can further comprise a stiffening element on the flat central region on the opposite side of the membrane to the coil.

The speaker can further comprise a support structure which defines a back volume, wherein the back volume is less than 1 $cm^3$. The use of the high compliance membrane enables a low back volume for a given acoustic response. The back volume can be less than 0.5 $cm^3$. The resonant frequency is preferably below 300 Hz, or more preferably below 250 Hz.

The invention also provides a method of manufacturing a speaker, comprising:

forming a membrane from an elastomer, wherein the membrane has thickness less than 0.3 mm and a Young's modulus below 100 MPa;

attaching a coil to the membrane; and assembling the speaker by suspending the membrane, such that the coil is positioned around a permanent magnet.

Figure 2:
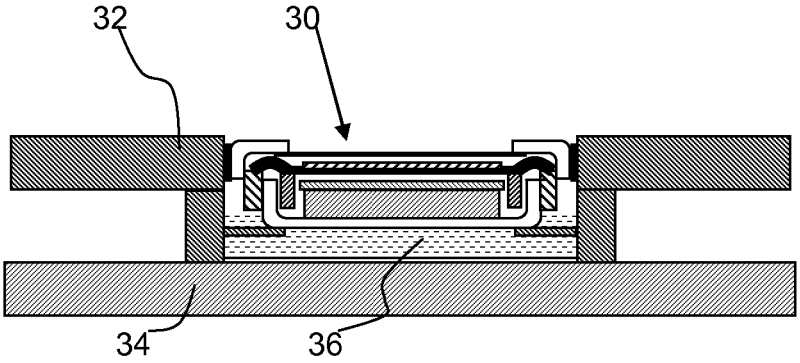

An example of the invention will now be described with reference to the accompanying drawings, in which:

FIG. 1 shows a known speaker configuration, and in which the membrane design of the invention can be employed; and FIG. 2 shows the speaker mounted to a device to define a back volume.

The invention is based on the recognition that a reduction in the compliance of the membrane can provide a reduced resonant frequency, and thereby give rise to improved wideband performance. Furthermore, the invention is based on the recognition that if the compliance can reduced drastically to provide extremely soft membranes, the back volume becomes dominant in determining the resonant frequency, and this enables a speaker with reduced variation in acoustic performance as a result of manufacturing tolerances.

The production of the very soft membranes of the invention using a conventional deep-drawing forming method is not practical. The desired thickness of the membrane is very small, in the region of 10 micrometers. To produce small thin membranes, very thin foils would need to be deep-drawn. To produce very soft membranes, the foils should be either very soft, or/and very thin or/and should be deep-drawn with a high deformation ratio. Thus, very thin soft foils are extremely difficult to produce. In particular, the deep-drawing of very thin foils using high deformation ratio results in instable deep drawing processes and poor reliability.

The conventional membrane films are also temperature dependent and sensitive. For example, soft thermoplastic foils have high damping ability but the stiffness (Young's Modulus E) and thus the resonant frequency is influenced strongly by the temperature. This is a serious problem, since the service temperature of the micro speaker can lie between −40° C. and +110° C. Conventional stiff temperature-independent foils can achieve higher damping by increasing the thickness of the foils, but the stiffness of the membrane then increases linearly and the resonant frequency becomes higher in addition.

Very thin, small membranes made by conventional processes also have the problem of poor stability of the thickness. A large variation of membrane-thickness results in high variance in the compliance and the resonant frequency.

Before explaining the membrane design of the invention, an outline will first be given of the speaker structure.

FIG. 1 shows schematically the structure of a general dynamic micro-speaker.

The speaker comprises a magnetic circuit for generating magnetic flux, a vibration system that vibrates due to repulsive force against the magnetic flux acting on the magnetic circuit, and a main body.

The magnetic circuit comprises a permanent magnet 2, a yoke 4 with the permanent magnet 2 contained therein, and an upper plate 6 attached to an upper surface of the permanent magnet 2.

The vibration system comprises a voice coil 8 fitted into a gap between the permanent magnet 2 and the inner diameter of the yoke 4. The voice coil 8 generates the magnetic flux when an electric current is driven into the coil. The electrical connections to the coil are not shown, and spring clips are typically used for this purpose, providing external connections to the voice coil.

The speaker membrane 10 is bonded to the voice coil 8. The membrane 10 has a flat central region 12 and a torus forming a supporting edge region, which defines the compliance of the membrane 14.

A stiffening element 16 is provided on (and bonded to) the flat central region 12 on the opposite side of the membrane 10 to the coil 8.

The speaker has a main body in the form of a frame 18 to which the membrane is fixed and a lid part 20. The lid has an opening 22 at the top which houses a damping member 24, which defines the output surface of the speaker. The damping member 24 has an array of openings to allow air flow in response to movement of the membrane as well as to provide output openings for the sound. A protective top part can also be fixed to the top of the lid part 20 (not shown). A vent 25 is also provided in the yoke for venting the volume beneath the membrane.

This is only one possible design to which the invention can be applied. Typically, a lower limit frequency (for reproduction of bass sounds) in micro speakers is 750 Hz or higher. This means the bass quality is poor and conventional micro speakers reproduce only sharp and noisy sounds excluding softness and vividness from the overall reproduced sound quality.

The invention relates specifically to the membrane design, and provides a design which enables the lower limit frequency to be reduced and/or enables the back volume to be reduced to enable a more compact design.

The invention provides a membrane which comprises an elastomer of thickness less than 0.3 mm and with a Young's modulus below 100 MPa. The Young's modulus can be below 50 MPa, more preferably below 12 MPa and even below 10 Mpa. This provides an extremely soft membrane.

The use of such extremely soft membranes enables very low resonant frequencies of the speakers, even if the back volume is very small. The back volume can be reduced, for example by a factor of 2 compared to the same design with a conventional membrane. This means that a wide band application can be achieved in the smallest possible space.

FIG. 2 shows the speaker 30 mounted in a device, which has a top casing 32 and a bottom casing 34, between which a closed back volume 36 is defined. This may be an air chamber, or there may be damping components in the volume. The casings together define a seating arrangement for the speaker as schematically shown. The back volume may be of the order of 1 $cm^3$, but the invention can enable a reduction in the back volume size.

The resonant frequency of the speaker can be derived from:

$$f_{res} = \frac{1}{2\pi}\sqrt{\frac{k_M + k_{BV}}{m}} \tag{1}$$

Where $f_{res}$ is the resonant frequency, $k_M$ is the membrane stiffness, $k_{BV}$ is the back volume stiffness and m is the moving mass. It can be seen that a low resonant frequency can be obtained by lowering the stiffness of the membrane and/or the back volume. The back volume stiffness is zero for free space; the smaller the back volume, the greater the stiffness. Thus, there are conflicting requirements for a large back volume in order to achieve good wide-band response and a small back volume to achieve good compactness.

By making the compliance (which is the inverse of stiffness k) of the membrane extremely high, the resonant frequency of the speaker is dominated by the stiffness and therefore size of the back volume. For the same reason, process variations in the stiffness and thickness of the extremely soft membranes do not influence the resonant frequency. The compliance of the membrane is preferably at least a factor of 10 higher than the compliance of the back volume, so that the resonant frequency of the speakers is determined almost solely by the back volume.

The damping ability of the membrane can be adjusted either by using higher damping material or higher thickness. However, these measures do not influence the resonant frequency in the case of membranes with extremely high compliance. Even if the compliance of the membrane is temperature-dependent, the effect on the resonant frequency is negligible.

The desired extremely soft membranes can be produced using elastomer materials. The compliance of these materials is up to 10,000 higher than the compliance of conventional membrane foils.

The elastomer materials are also less temperature dependent.

A membrane using an elastomer material can be injection molded. This is a very stable process with very small variation of the thickness of the membranes. In addition, unlike a deep drawing process, injection moulding does not produce scrap material, and thus it is an environmentally beneficial process.

The elastomer material is cheaper than a thermoplastic foil, and does not produce toxic gases during the product lifetime.

The edge torus region and central region of the membrane can be designed independently from each other but injection moulded as a single component. Using insertion or 2-component technology, the number of process steps can be reduced. The 2-components for 2-component technology can be for example the frame and the membrane, or the stiffening element and the membrane.

The elastomer membrane can be bonded to the frame 18 and the coil 8 using conventional adhesives. The elastomer membranes do not break over time, ensuring a long lifetime.

The resonant frequency can be reduced to below 400 Hz, or below 300 Hz or 250 Hz for strong bass performance with flat output response. The dimensions of the speaker will typically of the order of 10-20 mm by 10-20 mm, and approximately 3 mm thick. The speaker thus has a surface area of the output surface of less than 400 $mm^2$.

Stiffening elements can be used, as outlined above. The mass m in equation (1) includes the mass of the voice coil, of the membrane and of the stiffening element.

The elastomer material has high elasticity, high elongation at break and very low Young's modulus. In addition, the glass transition temperature is below room temperature.

The injection moulding process can typically give thickness variations with ±6%, compared to typical variations of up to ±10% for convention deep drawn foils. This gives smaller variation of the resonant frequency, both because of the larger dependence on the back volume which is easily controlled, and the reduced process variation of the membrane.

The demand for smaller and thinner designs especially for portable acoustic devices makes the use of very soft membranes with small back volumes and wide-band solutions (resonant frequency as low as possible) very attractive.

Examples of suitable elastomers are:

Rubbers: (for example CSM: Chlorosulphonated Polyethylene Rubber, MVQ: Methyl-Vinyl-Silicon Rubber MVQ).

Silicones: (for example LSR: Liquid Silicone Rubber, RTV: Room Temperature Vulcanization Rubber, HTV: High Temperature Vulcanization Rubber).

Thermoplastic Elastomers: (for example TPC: Thermoplastic Copolyester Elastomer, TPE-E: Thermoplastic polyester elastomers).

Various modifications will be apparent to those skilled in the art.

The invention claimed is:

1. A speaker comprising a permanent magnet, and a coil positioned around the permanent magnet and attached to a membrane, wherein the membrane is a single layer monolithic structure formed from an elastomer of thickness less than 0.3 mm and with a Young's modulus below 100 MPa.

2. A speaker as claimed in claim 1, wherein the elastomer comprises a silicone.

3. A speaker as claimed in claim 1, wherein the membrane is injection moulded.

4. A speaker as claimed in claim 1, wherein the membrane comprises a flat central region and a supporting edge region, and wherein the speaker further comprises a stiffening element on the flat central region on the opposite side of the membrane to the coil.

5. A speaker as claimed in claim 1, further comprising a support structure which defines a back volume, wherein the back volume is less than 1 $cm^3$.

6. A speaker as claimed in claim 5, wherein the back volume is less than 0.5 $cm^3$.

7. A speaker as claimed in claim 1, wherein the resonant frequency is below 300 Hz.

8. A speaker as claimed in claim 7, wherein the resonant frequency is below 250 Hz.

9. The speaker of claim 1, wherein the membrane is formed from an elastomer having a Young's modulus below 50 MPa.

10. The speaker of claim 1, wherein the membrane is formed from an elastomer having a Young's modulus below 12 MPa.

11. The speaker of claim 1, wherein the membrane is formed from an elastomer having a Young's modulus below 10 MPa.

12. A method of manufacturing a speaker, comprising:

forming a membrane from an elastomer, wherein the membrane is a single layer monolithic structure and has thickness less than 0.3 mm and a Young's modulus below 100 MPa;

attaching a coil to the membrane; and assembling the speaker by suspending the membrane, such that the coil is positioned around a permanent magnet.

13. A method as claimed in claim 12, wherein the elastomer comprises silicone.

14. A method as claimed in claim 12, wherein the membrane is formed using injection moulding.

15. A method as claimed in claim 12, wherein the membrane is formed with a flat central region and a supporting edge region, and wherein the method further comprises providing a stiffening element on the flat central region on the opposite side of the membrane to the coil.

16. A micro speaker comprising:

a body portion comprising a frame and a lid, the lid having an opening;

a magnetic circuit comprising a yoke, a permanent magnet contained within the yoke, and an upper plate attached to an upper surface of the permanent magnet; and a vibration system, comprising:

a voice coil fitted into a gap between the permanent magnet and an inner surface of the yoke; and a speaker membrane attached to the voice coil and affixed to the frame, the speaker membrane formed from a single layer elastomer having a thickness less than 0.3 mm and a Young's modulus below 100 MPa.

* * * * *